United States Patent [19]

Mumford

[11] 4,230,230

[45] Oct. 28, 1980

[54] PLASTIC OVERCAP FOR BOTTLE PACKAGE

[75] Inventor: George V. Mumford, Toledo, Ohio

[73] Assignee: Owens-Illinois, Inc., Toledo, Ohio

[21] Appl. No.: 34,716

[22] Filed: May 1, 1979

[51] Int. Cl.[3] ..... B65D 41/16; B65D 41/18; B65D 41/22

[52] U.S. Cl. ..... 215/321; 215/277; 215/317; 215/DIG. 7; 220/306; 222/182

[58] Field of Search ..... 215/277, 321, 317, DIG. 7; 220/306, 256; 222/182

[56] References Cited

U.S. PATENT DOCUMENTS

| | | | |
|---|---|---|---|
| 2,973,881 | 3/1961 | Ostrowitz | 220/306 |
| 3,941,275 | 3/1976 | Simmons | 220/306 X |

*Primary Examiner*—George T. Hall
*Attorney, Agent, or Firm*—John R. Nelson; Myron E. Click; David H. Wilson

[57] ABSTRACT

A cup-shaped overcap made of deformable plastic material is provided with plural protruding lugs along the inside surface of the cup wall nearly adjacent the open end of the overcap. The lugs snap over the apex of an annular bead on a bottle holding the cap in inverted position over a closure on the filled bottle. The overcap protects the closure and end of the bottle and provides a drinking/measuring cup for use with the bottle and contents. The lugs and bead provide for arcuate distortion of the cap when applied, which permits use of less rigid tolerances in cap and bottle.

5 Claims, 3 Drawing Figures

PLASTIC OVERCAP FOR BOTTLE PACKAGE

THE INVENTION

The invention relates to an overcap for a closed container which functions to protect the upper, closed end of the container and provide a removable drinking or measuring cup for the contents.

In the prior art, there are overcaps utilized which protect the capped or sealed end of a container. Examples of this are given by U.S. Pat. No. 2,973,881 in which an overcap snaps over a flange of a can of pressurized product to protect the discharge valve mechanism of the can package when not being used. Another example in U.S. Pat. No. 3,396,866 which shows an overcap for protecting the dispensing mechanism of an aerosal container.

Also, in the prior art there are overcaps on containers utilized with the container for display and measuring from the contents (U.S. Pat. No. 2,902,191), or provide a "dose cup" for a medicine bottle (U.S. Pat. No. 525,753), or provide a drinking cup for a vacuum bottle (U.S. Pat. No. 3,076,575).

SUMMARY OF THE INVENTION

It is the purpose of this invention to provide an overcap of a deformable, plastic material for a container, such as a capped glass bottle, which will protect the capped end of the bottle from dirt and abuse, and will be removable and useable for a measuring or drinking cup in conjunction with the packaged contents. Although this combined general function of overcap and container is known; the invention hereinafter disclosed with particularity in the description of an embodiment thereof provides a means to accommodate relatively wide tolerances in the variation between diametrical dimensions of the overcap and container at the region where the two are joined by snap action fit. The invention provides a molded plastic overcap having a multiplicity of interference lugs near its one open end and the lugs fit with an undercut groove and annular bead projection on the upper body of the container. The lugs permit distortion of the wall of the overcap by a "triangulation effect" between spaced points of the lugs and in so doing distort the circular shape of the wall at the circumferential location of the lugs thereon into a joined series of increased radii arc segments running from lug to lug; i.e. the circular section is distorted into a polygonal section of arcuate sides. This feature provides a "bow string" principle furnishing a means of accommodating wide diameter variations of the container and overcap relationship that come about in normal production of each item.

The dimensional variation in blow molding of bottles, for example from glass, has characteristically wide dimensional variations in the shoulder and body regions. Closer tolerances are maintained in the closure receiving finish area by pressing that part of the container. The invention therefore becomes very practical and important for use of an overcap on a conventional blown container, such as a glass bottle.

DETAILED DESCRIPTION OF THE DRAWINGS

Figure 2:
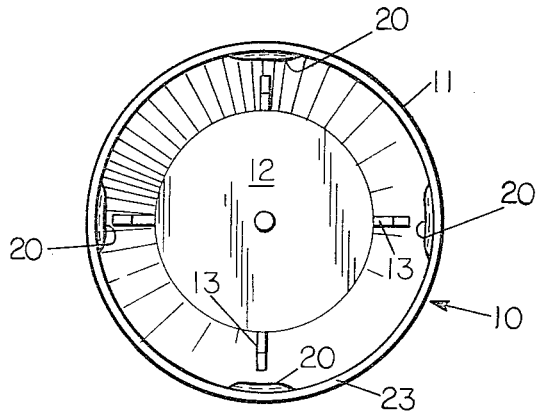
FIG. 2 is a bottom plan view of the overcap of the invention separate from the bottle showing the interior of the overcap.

The overcap 10 of the present invention is shown on FIG. 2 as it is molded from a deformable plastic material, such as for example polyethylene, polypropylene, polyethylene terethyalate (PET), styrene, polyvinyl chloride. The overcap 10 constitutes a cup or vessel having integral perimeter wall 11 and end or top wall 12 (in position shown on FIG. 1) for use with a container, such as the glass bottle 14 shown on FIG. 1. Along the interior surface of wall 11 are a plurality of inwardly protruding lugs 20. The lugs 20 are of an annular arc extent as shown on FIG. 2 and are shaped in axial section so as to be tapered downwardly and inwardly to an apex, as shown on FIG. 1. Annularly spaced vertical ribs 13 are provided eminating from the end wall 12 of the overcap and extending downwardly in an axial direction along the inside of wall 11. Ribs 13 are provided to prevent one cap from becoming wedged into another when nesting occurs, such as in precapping shipment or handling of caps in packaging operations.

Figure 1:
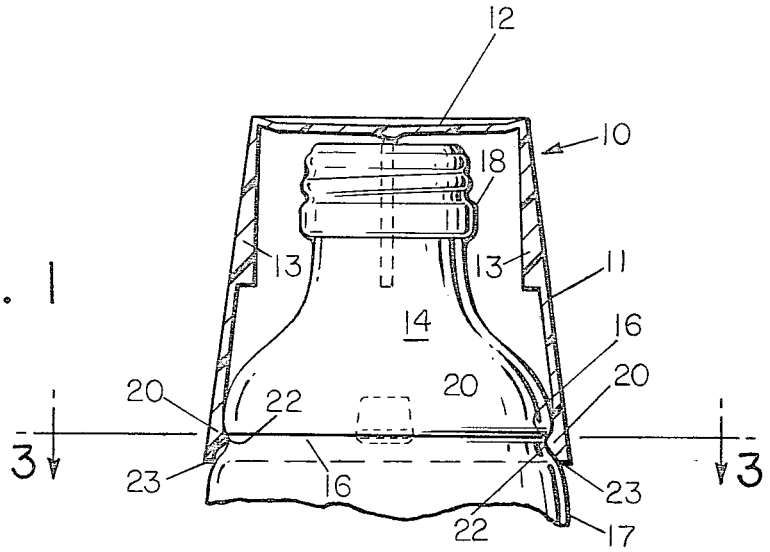
FIG. 1 is a side elevational view of the upper portion of a glass bottle and threaded closure and a sectional elevational view of the plastic overcap of this invention attached on the bottle.

The lugs 20 are shown as four, equally spaced apart protruding lugs and each include an integral upper vertical rib portion eminating from near the top of the inner side wall 11, and the lugs each taper to their apex 22 (FIG. 1) which permits easier stripping of the lug upon removal of the overcap from a container. Also, the rib portion provides a positive diameter for function with the mating diameter of the bead of the container (FIG. 1) at its apex 16 (Also represented by circular outline on FIG. 3.). Below the apex 22 the lug 20 tapers abruptly into the wall 11, which may extend for a distance to the open perimeter rim 23, the lower terminal end of the cap wall. This lower wall extension of overcap 10 fills the annular groove below the bead on the bottle surface to blend with the container side wall at the point where it blends with the outer body surface 17 (FIG. 1). Thusly, the lower skirt extension covers the gap created by the groove in the bottle between the annular bead apex 16 and the body wall surface 17. By design of the size of rim 23 and extension of the lower wall below the lugs 20, the wall extension may engage the bottle wall, as shown on FIG. 1, to absorb vertical loading forces frequently encountered by the package in handling, storage, etc.

The bottle 14 is provided with a conventional finish and closure, such as the rolled on threaded metal closure 18 shown on FIG. 1. By this example, the bottle and closure are resealable for the contents should the need to reseal between uses arise; that is, the bottle need not be a single use package.

Figure 3:
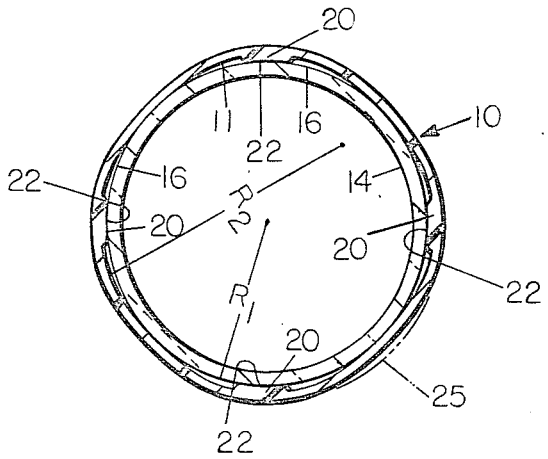
FIG. 3 is a sectional view taken along line 3—3 on FIG. 1, showing the deformation of the wall of the overcap in the annular section inclusive of the several interior lugs while engaged in the retaining bead or groove of the bottle.

In actual practice since bottle body diameters (at circumference 16) vary over a substantial range, it is normally uneconomical to provide caps to fit a selected narrow tolerance range of bottle specifications. The overcap of the present invention permits utilization of materials which cannot be stretched, e.g. are not resilient, but which can be deformed or distorted to some degree without fracture or rupture. Referring to FIG. 3, it may be seen that by this deformation feature, if the smallest bottle is matched with the largest cap a minimum fit is achieved. As the bottle bead diameter becomes larger or cap skirt wall diameter gets smaller, the cap wall distorts to accommodate the tighter fit by the side wall segment between the adjacent lugs 20 assuming a position somewhere between the normally molded constant radius arc (radius $R_1$ on FIG. 3) and a straight line (the "bow string" principle); most likely the wall segment is distorted to an arc whose radius is increased to that of $R_2$. The radii shown as $R_1$ and $R_2$ on FIG. 3 are with reference to the interior surface of the cap wall. The original arcuate shape of the outer surface of the cap wall is represented by phantom line 25.

In the wall deformation just described, the normal circular section configuration (circle 25) of the overcap side wall in the region between the lugs 20, which engage over the apex of the bottle side wall bead, will deform to other than circular section (as shown on FIG. 3) to adjust to an appropriate fit in attaching the overcap 10 onto the top end of bottle 14 in the inverted fashion shown and hold it in place for proper function of the overcap. This may be referenced as a "triangulation" effect; as distinct from the section of the wall staying circular.

The overcap is manually removable by a canting, lifting motion to disengage lugs 20 and bead 16 of the package, and the overcap is useable as a drinking cup or measuring cup in relation to using the contents of the bottle.

The package may be further enhanced by attractive labelling or decoration on the outer surface of the overcap 10 or on the bottle side wall 17 below the retaining bead and groove. The overcap may be molded in a number of attractive shapes and designs.

I claims:

1. A container package comprising the combination of a container having an annular body wall including a neck and closure receiving finish at one end defining an opening and a closure engaged thereon closing the container, the annular body wall including an annular bead spaced below the finish and having an apex thereon and groove of lesser diameter below said apex, an overcap of generally cup-shaped configuration made of a deformable plastic material, said overcap including an integral end wall and annular side wall, the latter defining a circular rim opening opposite the end wall, a plurality of inwardly protruding lugs on the inside of said annular side wall approximately adjacent said rim end thereof, each of said lugs including an axial, downwardly and inwardly tapering rib and apex, the apex of said lugs being described to lie along a generally circular line projection, the diameter of said circular line projection being less than the diametrical apex dimension of said annular bead on the container wall, the lugs of the overcap engaging collectively over said bead on the container and axially beyond the apex in a cup-inverted fashion placing the annular section of the overcap side wall in tension and distorting the arcuate configuration of the side wall segment between two adjacent lugs thereon to a segment of increased radius.

2. The package of claim 1 in which the rim of the overcap on the side wall thereof is extended below the lugs thereon and encircling said groove of the container side wall, said rim diameter being substantially that of the annular body wall of the container below the said annular groove thereon, and when in said assembled inverted position on the container the rim of the overcap engages said container body wall, whereby the overcap absorbs a portion of vertical end loading on the package.

3. The overcap of claim 1 comprising four equally spaced apart lugs.

4. The package of claim 1 which the container comprises a glass bottle.

5. The package of claim 1 in which the overcap is made from polystyrene.

* * * * *